US005148798A

United States Patent [19]

de Kock

[11] Patent Number: 5,148,798

[45] Date of Patent: * Sep. 22, 1992

[54] STOVE FOR BURNING SOLID FUEL

[75] Inventor: Gerardus J. A. de Kock, Heesch, Netherlands

[73] Assignee: Oliehandel de Kock B.V., Heesch, Netherlands

[ * ] Notice: The portion of the term of this patent subsequent to Nov. 22, 2005 has been disclaimed.

[21] Appl. No.: 65,763

[22] Filed: Jun. 24, 1987

[30] Foreign Application Priority Data

Jun. 26, 1986 [NL] Netherlands ..... 8601677

[51] Int. Cl.[5] ..... F24B 1/08

[52] U.S. Cl. ..... 126/10; 126/15 A; 126/77; 110/293; 110/327

[58] Field of Search ..... 126/10, 5, 7, 19 R, 126/20, 34, 73, 15 A, 77; 110/267, 293, 327; 122/30, 494

[56] References Cited

U.S. PATENT DOCUMENTS

| | | | |
|---|---|---|---|
| 1,988,238 | 1/1935 | Coplen | 126/5 |
| 2,340,431 | 2/1944 | Satchwell | 126/30 |
| 2,612,877 | 10/1952 | Cubitt | 122/30 |
| 2,743,718 | 5/1956 | Kindig | 126/5 |
| 2,804,850 | 9/1957 | Vorkauf | 122/30 |

FOREIGN PATENT DOCUMENTS

| | | |
|---|---|---|
| 366166 | 12/1929 | Belgium . |
| 518541 | 4/1953 | Belgium . |
| 152317 | 8/1985 | European Pat. Off. . |
| 103416 | 7/1962 | Netherlands . |
| 407847 | 4/1979 | Sweden . |
| 323536 | 9/1957 | Switzerland . |
| 1027442 | 4/1966 | United Kingdom . |

*Primary Examiner*—Larry Jones
*Attorney, Agent, or Firm*—Fisher, Christen & Sabol

[57] ABSTRACT

A stove for burning solid fuel, such as coke or coal, comprises a feed hopper for storing a stock of fuel and a supporting member for supporting fuel present in a fireplace. The feed hopper is in communication near its lower side with the space incorporating the fireplace via a downwardly sloping fuel supply channel. The boundary walls of the channel are arranged one above the other. A passage is provided for the supply of primary combustion air near the lower side of the combustion chamber. An inlet passage for the supply of secondary combustion air is provided above the combustion chamber. The primary combustion air is sucked-in with the aid of a fan disposed upstream of the combustion chamber. The passage for supplying the primary combustion air is automatically closed by a valve when the fan is made inoperative.

23 Claims, 4 Drawing Sheets

STOVE FOR BURNING SOLID FUEL

BACKGROUND OF THE INVENTION

The invention relates to a stove for burning solid fuel, such as coke or coal, comprising a feed hopper for storing a stock of fuel and a supporting members for supporting fuel present in a fire place, the feed hopper being in communication near its lower side with the space incorporating the fire place via a downwardly sloping fuel supply channel, which is bounded by boundary walls which are arranged one above the other and are interspaced by a distance of between 7 and 11 cms, whilst the arrangement further includes a passage for the supply of primary combustion air neat the lower side of the fire place and an inlet passage for the supply of secondary combustion air above the fire place.

Such a stove is disclosed in the Belgian patent specification 366,116. In said document the downwards sloping fuel supply channel ends at a fairly large distance above the supporting member supporting the fuel in the fireplace so that a relatively large quantity of fuel will invariably be present in the fire place on the supporting member. In addition, as far as can be ascertained from said document, the passage of air is effected by natural draught in the chimney. In operation, a relatively large quantity of fuel will here always be present in the fire place which in itself is already disadvantageous for realizing a fast responding, efficient and economic control of the combustion process in the combustion chamber. Furthermore, this Belgian patent specification does indeed state that a controllable quantity of primary combustion air can be supplied but any further indication as regards this control is lacking.

SUMMARY OF THE INVENTION

The invention has for its object to provide a stove of the type defined in the foregoing, which can be operated with a maximum of efficiency.

According to the invention, this can be accomplished in that the lowermost point of the lower boundary wall of the fuel supply channel is located at a distance of approximately 15–25 cms form the supporting member disposed therebelow, whilst the primary combustion air is sucked-in with the aid of a fan disposed upstream of the fire place form the passage for supplying the primary combustion air, which passage is automatically closed by a valve when the fan is made inoperative.

Using the construction according to the invention, an effective size of the combustion chamber is obtained, such that this combustion chamber is neither too small which, in operation, might cause a relatively excessive air flow, nor too large since too large a combustion chamber may result in too large a quantity of unburned fuel and a significant soot production. In addition, using the construction according to the invention, it is also provided that the combustion air drawn with the aid of the fan through the fire place is passed as advantageously as possible through the fire place which also contributes towards an optimum combustion. By the automatic closing of the passage for the supply of primary combustion air on turn-off of the fan, whose operation will generally depend on the heat demand, an unwanted, continued burning of the fuel in the fire place at those instants at which no supply of heat is required, will be prevented, so that the combustion of the fuel can be efficiently matched to the demand for heat.

It should be noted that the Swiss patent specification 323,536 discloses a stove in which primary combustion air is fed to the combustion chamber under pressure. This has the drawback that also over-pressure can be produced in the feed hopper and also that combustion gases can be fed to the interior of the feed hopper, which entails the risk of fire in the hopper. By exhausting the smoke gases from the stove, as used in the construction according to the invention, such drawbacks are obviated.

Passing of the fire into the interior of the hopper is further avoided in accordance with the inventive measure, in that on the one hand the walls of the hopper are cooled with water to be heated in the stove, whilst in addition the feed hopper also comprises means for exhausting the gas from the hopper.

The invention and how it can be carried into effect will now be described in greater detail with reference to an embodiment, shown schematically in the accompanying Figures, of a stove according to the invention.

DESCRIPTION OF THE PREFERRED EMBODIMENT

Figure 1:
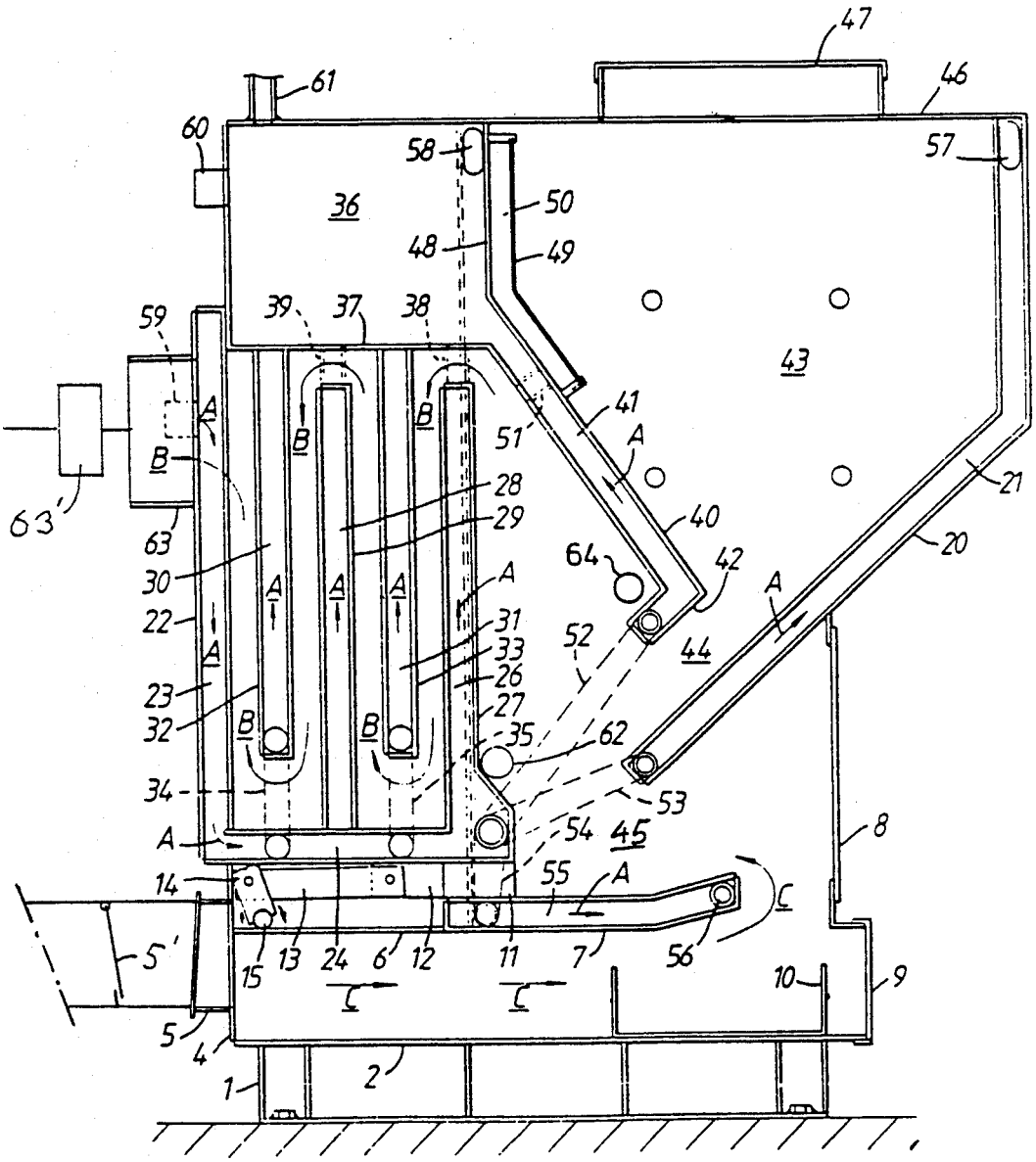
FIG. 1 is a cross-sectional view through an embodiment of a stove according to the invention.

The stove according to the invention includes two supporting beams 1, on which a horizontal plate 2 forming the lower boundary of the actual stove, bears. Upwardly extending side wall portions 3 are joined to the longitudinal edges of the plate 2, whilst an upwardly extending rear wall 4 is joined to the rear edge of the plate 2.

An air suction channel 5 which terminates in the space between the lower wall 2 and a plate 6 which extends at some distance above this lower wall 2 and between the side plates 3, is connected to the rear wall 4. A valve 5', which closes the air suction channel 5 should the underpressure in the space between the plates 2 and 6 disappear, is included in the air suction channel 5.

A double-walled supporting member 7 which originally extends from the plate 6 in the horizontal direction to pass thereafter into an upwardly sloping portion is contiguous along the overall width of the stove at that end of the plate 6 which faces away from the rear wall 4. The free end of the supporting member is at some distance from a front wall 8 of the boiler which near its lower side is provided with an aperture which can be closed by a door 9, via which an ashpan 10, which bears on the plate 2 and is located under the end of the supporting member 7 can be removed from the stove and inserted into the stove again.

A stower member 11 which is provided with lugs 12 at its rear side, and extends along the overall width of the supporting member bears on the rear end of the supporting member 7. By means of a coupling rod 13 these lugs 12 are coupled to lugs 14 which are connected to a shaft 15 which extends in the horizontal direction and along the overall width of the stove. To that end of this shaft 15 projecting outside the stove a lever, not shown, is fastened by means of which the shaft 5 can be reciprocated around its longitudinal axis. It will be obvious that such a rotation will result in a reciprocating movement of the stower member 11 over the supporting member 7, as a result of which the material bearing on the stower member 7, seen in FIG. 1, can be moved to the right through a given distance and so the material bearing on the right-hand portion of the supporting member 7 will be pushed over the end of this supporting member and will drop in the ashpan 10.

Figure 2:
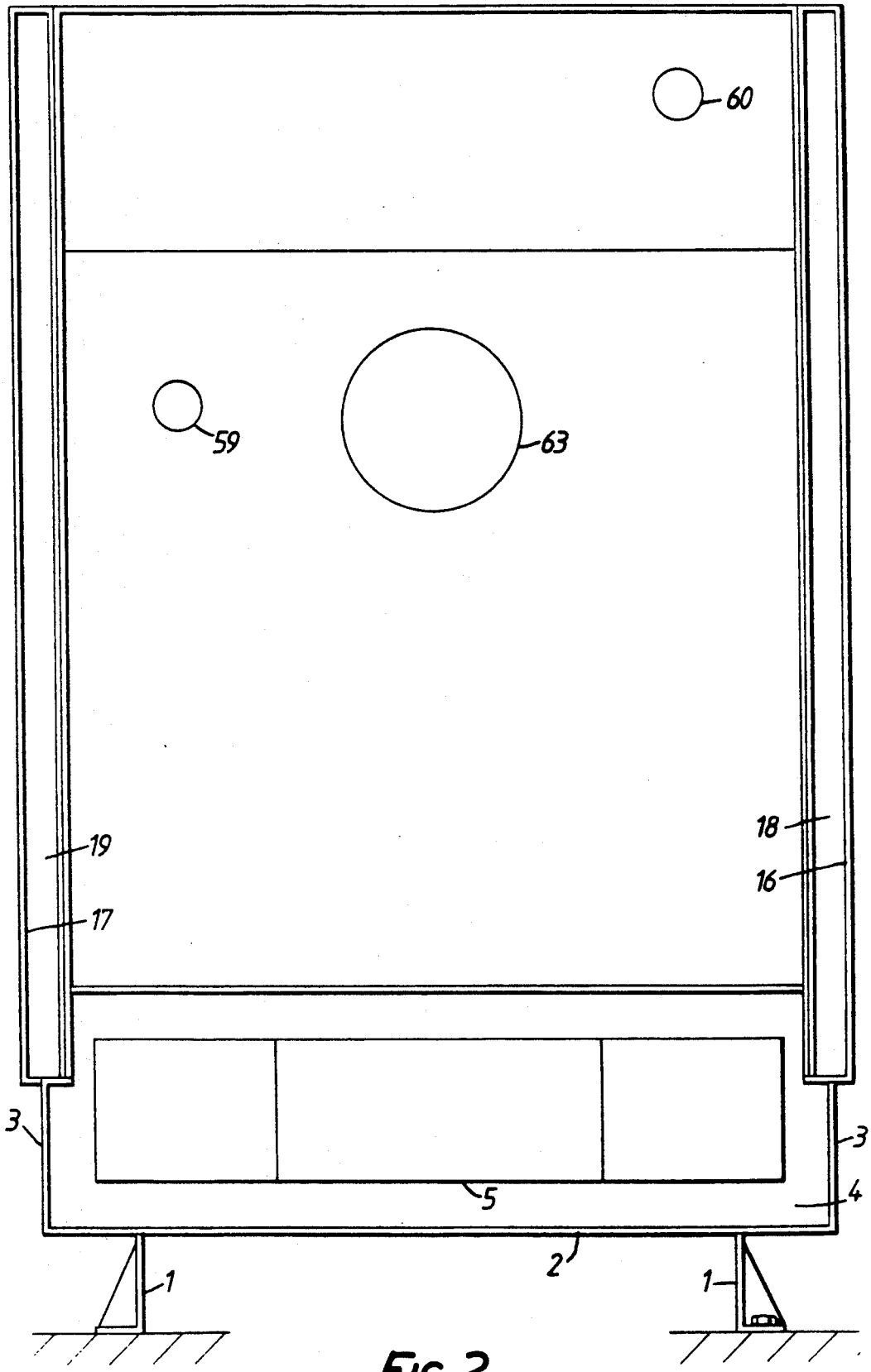
FIG. 2 is a rear view of the stove of FIG. 1, partly in a side view and partly in cross-section.
Figure 3:
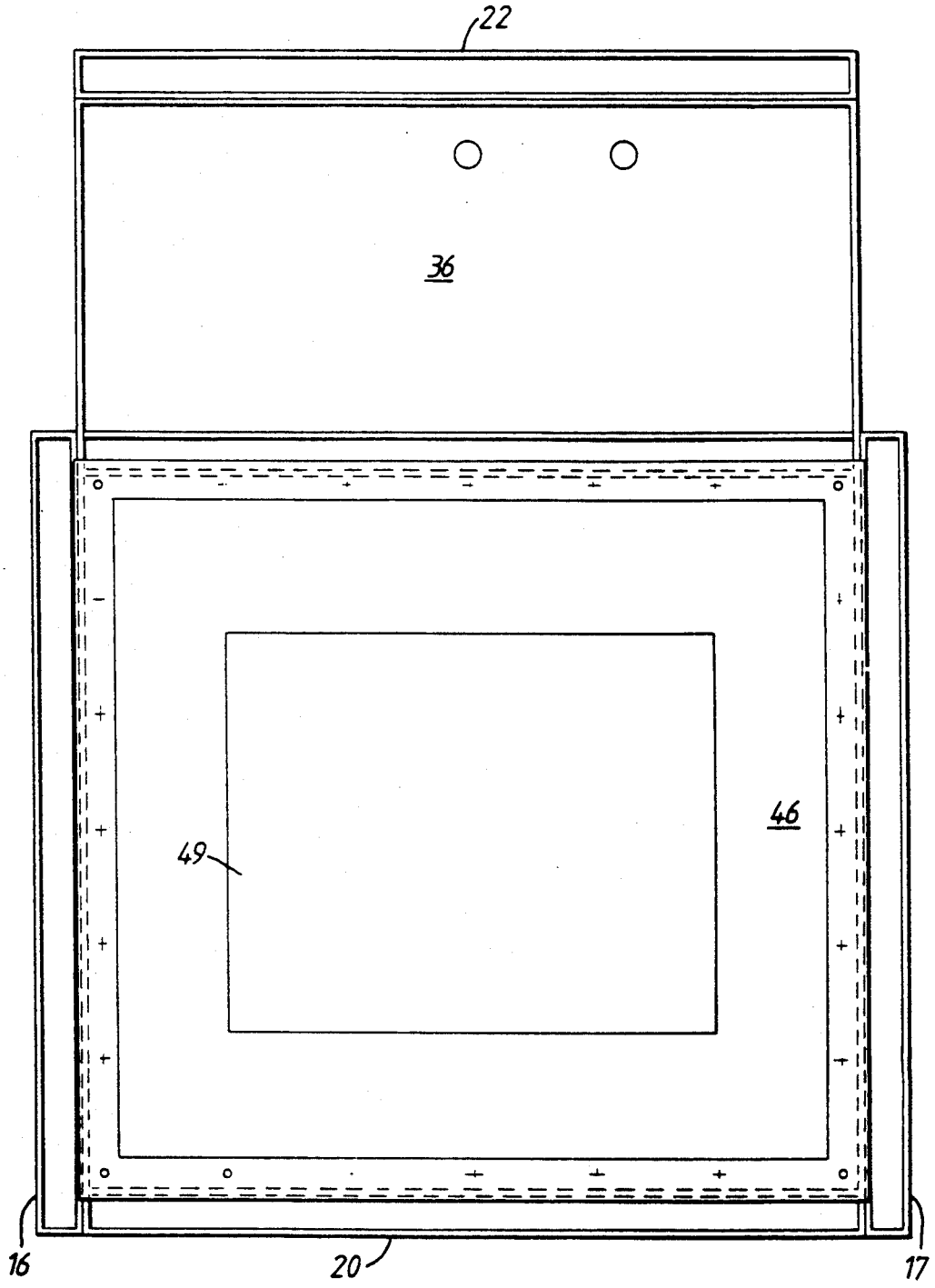
FIG. 3 is a plan view of the stove shown in FIG. 1, partly in cross-section.
Figure 4:
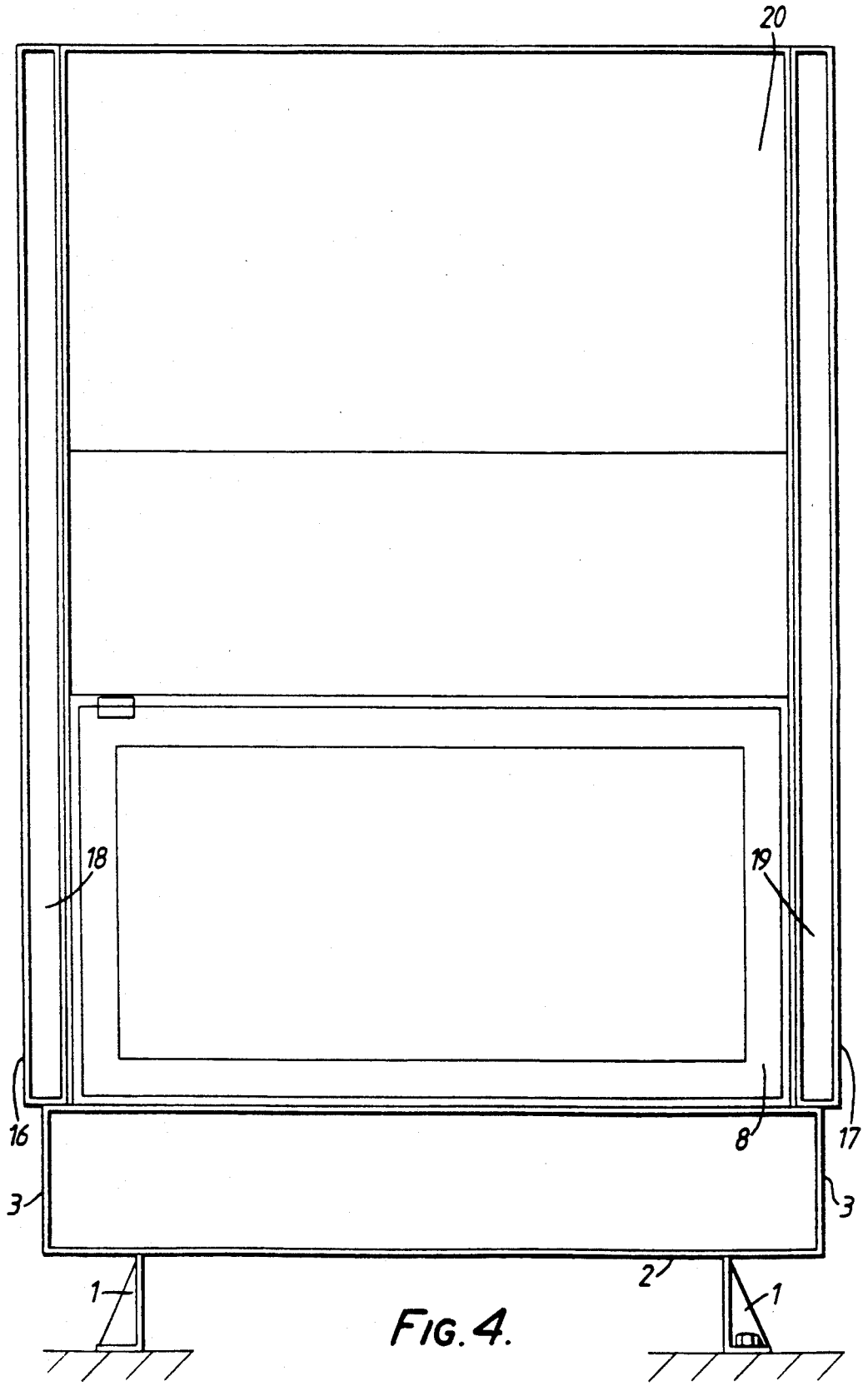
FIG. 4 is a front view of the stove shown in FIG. 1, partly in cross-section.

As will be obvious more specifically from the FIGS. 2 and 4, the two side walls 16 and 17 of the stove, but for the lowermost portions 3, are of a double-walled structure for forming water chambers 18 and 19, resp. A side wall 20 which is also of a double structure and bounds a water chamber 21, extends at the front of the stove between these side walls 16 and 17. As will be obvious more specifically from FIGS. 1, the lowermost portion of this side wall slopes upwardly at an angle of approximately 40° with respect to the horizontal, whilst the uppermost portion of this front wall extends in the vertical upward direction.

The rear side of the stove is bounded by a double-walled wall 22 which also extends between the side walls 16 and 17 and bounds a water chamber 23. At its bottom side this waterchamber is contiguous to a water chamber 24 which is bounded by a double-walled boundary wall 25 located at some distance above the plate 6. At that end facing away from the water chamber 23 the horizontally extending water chamber 24 is contiguous to the lower end of a vertically extending water chamber 26, which is bounded by a double-walled wall 27 located at some distance from the double-walled wall 22.

Approximately halfway between its two extreme ends, the horizontally extending water chamber 24 is in open communication with a water chamber 28, which is also bounded by a double-walled wall 29, which extends upwardly from the double-walled wall 25.

Provided between the double-walled wall 22 and the double-walled wall 29 and between the double-walled wall 29 and the double-walled wall 26 there are double-walled walls 32 and 33, resp. which bound respective water chambers 30 and 31 and whose lower ends are located at some distance above the double-walled wall 24.

The water chamber 24 is in communication with the lower end of the water chamber 30 via a connecting pipe 34 and in connection with the lower end of the water chamber 31 via a connecting pipe 35.

A water reservoir 36 is arranged above the vertically upwardly extending double walls 27,29, 32 and 33.

As will be obvious from FIG. 1, the upper ends of the double-walls 32 and 33 are contiguous to the bottom plate 37 of said reservoir 36, the water chambers 30 and 31 being in open communication at their upper ends to the interior of the water reservoir 36 via passages, not shown, provided in the plate 37.

The upper ends of the double-walled walls 27 and 29 are located at some distance from the bottom plate 37 and the upper ends of the water chambers 26 and 28 are connected to the interior of the water reservoir 36 via connecting pipes 38 and 39, resp.

As is shown in FIG. 1, a double-walled wall 40 which extends in the direction of the wall 20 and bounds a water chamber 41 which at its upper end is in an open communication with the interior of the reservoir 36, is contiguous to the right-hand lower corner of the reservoir 36. The lower end 42 of the double-walled wall 40 is bent with respect to the remaining portion of said wall 40, such that this lower end 42 extends in parallel with the double-walled wall 20. The spacing between the closest spaced wall portions of the double walls 20 and 42 is preferably approximately 9 cm.

The space 43 bounded by the double walls 20 and 40 and portions of the double side walls 18 and 19 constitutes a hopper 43 for accomodating the solid fuel to be burned, for example coke or coal. Said fuel can flow from the feed hopper via the channel 44 bounded by the wall 20 and the wall portion 42 to the space 45 which forms the fire place and is located above the supporting member.

The feed hopper, which is closed at its upper side by a plate 46 can be filled through a filler hole provided with a cover 47.

At some distance from the water reservoir 36, at the side of the wall 48 closing the feed hopper 43, and the upper portion of the wall 40 contiguous thereto a plate 49 is provided which extends in parallel with these wall portions and thus defines in the feed hopper a space 50 which extends between the side walls of the feed hopper and at its upper side is in an open communication with the interior of the feed hopper 43 and at its bottom side is in an open communication via a passage 51 provided in the double wall 40 with the space located above the fire place and between the double walls 40 and 27 in the region of the upper end of the double wall 27.

As is shown in FIG. 1, the lower end of the water chamber 26 is in open communication with the lower end of the water chamber 41 via a pipe 52, in communication with the lower end of the water chamber 21 via pipe 53 and, via a pipe 54, in communication with a water chamber 55 formed in the interior of the hollow supporting member 7. That end of this water chamber 55 facing away from the pipe 54 is in communication via connections 56 with the water chambers 16 and 17 bounded by the side walls 18 and 19. Similarly, the water chamber 21 is in communication via passage 57 located near the upper side of the water chamber 21 with the water chambers 18 and 19 bounded by the side walls 16 and 17, whilst said water chambers 18 and 19 themselves are in an open communication with the water reservoir 36 via passage 58.

For the supply of water to the stove, a supply pipe 59 which terminates in the upper end of the water chamber 23 is provided in the rear side (FIG. 2). For the discharge of the heated water a discharge pipe 60 is connected to the water chamber, whilst for filling the stove a filler pipe 61 is provided on the water reservoir.

In the region of the lower end of the double wall 20 a horizontal pipe 62, in which holes are pierced and which extends in parallel with the double wall 27 is provided, through which air can be sucked into the interior of the fire place 45. A further, perforated pipe 64 which extends parallel to the pipe 62 for the supply of combustion air is arranged just above the lower end 42 of the wall 40.

In operation, the water supplied via the pipe 59 will flow downwards through the water chamber 23 to the water chamber 24.

From this water chamber 24 a portion of the water will flow via the water chambers 26,28,30 and 31 to the water reservoir 36. A further portion of this water will be supplied to the water chambers 41 to flow from there to the reservoir 36. The remaining portion of the water will be supplied to the waterchambers 21 and 55 and from these water chambers via the water chambers 18 and 19 formed by the side wall it will also flow to the reservoir 36 from which the water will be discharged to members to be heated, such as, for example, radiators. The direction of flow of the water is indicated by arrows A.

The fuel contained in the feed hopper 43 will, when the stove is operative, gradually move via the passage 44 to the fire place 45 in which a quantity of burning fuel is present on the supporting member 7.

The distance between the extreme left point in FIG. 1 of the wall 21 and the supporting member 7 located there below is preferably approximately 18 cms. The distance between its most extreme left point of the wall 20 and the pipe 62 is approximately 15 cms.

Because of the above-mentioned small height of the channel 44 and the small distance between the lower end of the wall 20 and the pipe 62 and the supporting member 7, resp. , only a comparatively small quantity of fuel can always accumulate in the fire place 45. The smoke gases produced in the fire place will first flow up from the fire place 45 between the wall 27 and the wall 40 to subsequently move between various walls 27,33, 29,32 (arrows B) to a discharge pipe 63 which is connected to the rear wall of the stove and is connected to a chimney with the interposition of an exhaust fan 63'.

Gases are drawn from the feed hopper 43 in the region of the channel 44, as a result of which smoke gases will flow into the feed hopper via the passage 51 and the chamber 50. This operation of extracting any combustible gases from the feed hopper 43, and also the fact that the content of the feed hopper 43 is fully surrounded by double walls forming water chambers prevents the fire from passing from the combustion chamber 45 to the interior of the feed hopper 43 via the passage 44.

In operation, the action of the exhaust fan 63' can be controlled in dependence on the required heat and/or the water temperature prevailing in the water reservoir 36.

The supply of the combustion air which, as indicated by arrows C will flow during suction under the supporting member 7 and along the front side of the supporting member 7 upwards and back into the fire place 45 will, when the action of the fan drawing-in the smoke gases is interrupted be stopped since, as has already been described in the foregoing, a valve 5' which automatically closes when an underpressure disappears, is provided in the supply channel 5. When this air supply is interrupted, the combustion of the fuel in the combustion chamber will be stopped to a very significant extent, so that this fuel continues to glow only slightly. As soon as the exhaust fan is made operative again a very fast and strong increase of the combustion was found to occur. Additional combustion air will be fed forward via the supply pipes 62 and 64, as a result of which a very efficient after-burn of the gases released from the fuel will be effected.

Just because, as a result of the above-described constructional embodiment of the stove only a comparatively small quantity of fuel is present in the fire place 45, stopping or starting, resp. of said suction fan will effect a fast decrease in the combustion of the fuel in the combustion chamber or will effect a rapid increase of the combustion of the fuel in the combustion chamber, which contributes towards an economical operation of the stove.

By regularly reciprocating, the stower member 11, for example once in every 24 hours, the ash present on the supporting member 7 can be pushed over the front edge of this supporting member, so that this ash drops into the ashpan.

I claim:

1. A stove for burning solid fuel, such as coke or coal, comprising a feed hopper for storing a stock of fuel and a supporting member for supporting fuel present in a fire place, the feed hopper being in communication near its lower side with the space incorporating the fire place via a downwardly sloping fuel supply channel, which is bounded by boundary walls which are arranged one above the other and are interspaced by a distance of between 7–11 cms, whilst the arrangement further includes a passage for the supply of primary combustion air near the lower side of the combustion chamber and an inlet passage for the supply of secondary combustion air above the combustion chamber, characterized, in that the lowermost point of the lower boundary wall of the fuel supply channel is located at a distance of between 15–25 cms from the supporting member disposed therebelow, whilst the primary combustion air is sucked-in with the aid of a fan disposed upstream of the combustion chamber from the passage for supplying the primary combustion air, which passage is automatically closed by a valve when the fan is made inoperative.

2. A stove as claimed in claim 1, characterized in that the spacing between the boundary walls is approximately 9 cms.

3. A stove as claimed in claim 1 or 2, characterized in that the lowermost point of the lower boundary wall is located at a distance of approximately 18 cms from the supporting member.

4. A stove as claimed in claim 1, characterized in that the downwardly sloping channel extends at an angle of approximately 40° with respect to the horizontal.

5. A stove as claimed in claim 1, characterized in that, in a plan view, the supporting member extends on both sides of the lowest point, the supporting member extending at least substantial horizontally through a portion of its length, whilst the free end of this supporting member extends at an upward angle from a point which is located approximately perpendicularly below the lowermost point of the lower boundary wall of the channel.

6. A stove as claimed in claim 1, characterized in that the boundary walls of the feed hopper are at least predominantly of a double-walled construction and constitute water chambers which accommodate the liquid to be heated with the aid of the stove.

7. A stove as claimed in claim 1, characterized in that means for exhausting gas from the feed hopper are provided in the hopper.

8. A stove as claimed claim 1, characterized, in that at that side of the fire place facing away from the discharge aperture of the feed hopper there are provided between double-walled side walls of the stove forming water chambers, some at least substantially vertically extending double walls bounding water chambers between which a zig-zag path for the discharge of smoke gases is formed.

9. A stove as claimed in claim 8, characterized in that at their upper ends the water chambers are in communication with a water reservoir located above the water chambers.

10. A stove as claimed in claim 9, charcterized in that a double separating wall bounding a water chamber which extends at a downward angle is contiguous to a lower angular point of the water reservoir, the separating wall constituting a boundary wall of the feed hopper, and the fire place being located there below.

11. A stove as claimed in claim 9, characterized in that the lower end of the boundary wall is folded over at an approximately right angle and defines the downwardly-sloping channel together with the lower end of a further double boundary wall of the feed hopper, bounding a water chamber and extending in parallel therewith.

12. A stove as claimed in claim 2, characterized in that the lowermost point of the lower boundary wall is located at a distance approximately 18 cms from the supporting member.

13. A stove as claimed in claim 9, characterized in that the boundary wall contiguous to the water reservoir is provided with a passage which is in an open communication with a space which is open at its upper side and is screened in the feed hopper.

14. A stove as claimed in claim 1, characterized in that two perforated air supply pipes which extend between the side walls of the stove are arranged at some distance above the supporting member.

15. A stove as claimed in claim 10, characterized in that the boundary wall contingues to the water reservoir is provided with a passage which is in an open communication with a space which is open at its upper side and is screened in the feed hooper.

16. A stove as claimed in claim 9, characterized in that two perforated air supply pipes which extend between the 5 side walls of the stove are arranged at some distance above the supporting member.

17. A stove as claimed in claim 10, characterized in that two perforated air supply pipes which extend between the 5 side walls of the stove are arranged at some distance above the supporting member.

18. A stove for burning solid fuel, such as coke or coal, comprising a feed hopper (43) for storing a stock of fuel and a closed watercooled supporting members (7) for supporting fuel present in a fire place, the feed hopper (43) being in communication ear its lower side with the space incorporating the fireplace via a downwardly floping fuel supply channel (44), which is bounded by boundary walls (42,20) which are arranged one above the other and are interspaced by a distance of between 7–11 cms, whilst the arrangement further includes a passage (5) for the supply of primary combustion air near the lower side of the combustion chamber and an inlet passage (62, 64) for the supply of secondary combustion air above the combustion chamber, characterized, in that the lowermost point of the lower boundary wall (20) of the fuel supply channel (44) is located at a distance of between 15–25 cms from the closed watercooled supporting member (7) disposed therebelow, whilst the primary combustion air is suck-in via the passage (5) for supplying the primary combustion air, which passage (5) is automatically closed by a valve when the fan is made inoperative and two perforated pipes (62, 64) for supplying secondary air extend between the side-walls of the stove at some distance above the watercooled supporting member (7).

19. A stove for burning solid fuel comprising:

a) a feed hopper for storing solid fuel, b) a combustion chamber for burning the solid fuel, c) a supporting member for supporting the solid fuel in the combustion chamber, d) a downwardly sloping fuel supply channel having boundary walls which are arranged one above the other, said feed hopper being in communication with said combustion chamber for supplying the solid fuel from the feed hopper to the combustion chamber, e) a passage for the supply of primary combustion air below said supporting member, f) a passage for the supply of secondary combustion air above said supporting member for after-burn of the gases released from the burning solid fuel, g) a fan disposed at the exhaust side of the combustion chamber for sucking in combustion air through said passageways for the supply of primary and secondary combustion air, and h) a valve which automatically closes said passage for the supply of primary combustion air when said fan is made inoperative.

20. A stove as claimed in claim 19 wherein said supporting member is water-cooled and said passage for the supply of secondary combustion air comprises a perforated pipe located above the lower end of the lower boundary wall of said fuel supply channel.

21. A stove as claimed in claim 19 wherein the walls of said feed hopper are at least predominantly of a double-walled construction and constitute water chambers which accommodate the liquid to be heated with the aid of the stove.

22. A stove as claimed in claim 19 wherein means for exhausting gas from the feed hopper are provided in the hopper.

23. A stove as claimed in claim 19 wherein at least substantially vertically extending double walls are provided between which a zig-zag path for the discharge of smoke gases is formed.

* * * * *